United States Patent [19]

Ohnishi et al.

[11] 4,201,734

[45] May 6, 1980

[54] CARBURETOR

[75] Inventors: Takanori Ohnishi; Ken Shiozawa, both of Toyota; Nobuo Shimizu, Ohbu, all of Japan

[73] Assignees: Toyota Jidosha Kogyo Kabushiki Kaisha; Aisan Kogyo Kabushiki Kaisha, both of Aichi, Japan

[21] Appl. No.: 918,571

[22] Filed: Jun. 23, 1978

[30] Foreign Application Priority Data

Oct. 28, 1977 [JP] Japan ..... 52-129963

[51] Int. Cl.[2] ..... F02M 7/08

[52] U.S. Cl. ..... 261/34 B; 417/540; 261/DIG. 74

[58] Field of Search ..... 261/34 B, 34 A; 417/540

[56] References Cited

U.S. PATENT DOCUMENTS

| | | | |
|---|---|---|---|
| 2,183,636 | 12/1939 | Berry | 261/34 A |
| 2,363,223 | 11/1944 | Bonnier | 261/34 A |
| 2,453,728 | 11/1948 | Rauen | 261/34 A |
| 2,551,719 | 5/1951 | Ball | 261/34 A |
| 3,437,081 | 4/1969 | Mennesson | 261/34 A |
| 4,025,588 | 5/1977 | Nakamura et al. | 261/34 A |
| 4,088,102 | 5/1978 | Kato | 261/34 B |

FOREIGN PATENT DOCUMENTS

| | | | |
|---|---|---|---|
| 421332 | 5/1947 | Italy | 261/34 A |

*Primary Examiner*—Tim R. Miles

*Attorney, Agent, or Firm*—Koda and Androlia

[57] ABSTRACT

A carburetor having an accelerator pump for pushing fuel contained in the chamber of the pump into an air intake passageway of the carburetor by means of an accelerating pump piston during acceleration, a second pump chamber being expandable and contractable and communicating with the pump chamber via a throttle and a pressure control means for constantly applying pressure to said second pump chamber in a direction whereby the second pump chamber is allowed to expand only when fuel pressure in the second pump chamber exceeds a predetermined value.

4 Claims, 4 Drawing Figures

CARBURETOR

BACKGROUND OF THE INVENTION

1. Field of Invention

This invention relates to carburetors and more particularly to carburetors provided with acceleration pumps.

2. Prior Art

In carburetors provided with prior art accelerating pumps, a satisfactory quantity of fuel is supplied at the first stage of rapid acceleration to improve the response of the engine to acceleration. However, the time during which fuel for acceleration is supplied as short. Since the time during which fuel for acceleration is supplied is short, during the time from the completion of the supply of fuel for acceleration to a stabilized condition of supplying fuel from a fuel feed port the air fuel mixture taken into the engine is lean. Since during this time the air fuel mixture is lean, it becomes difficult to smoothly accelerate the engine. In particular, when the engine is cold, this tendency is increased.

To obviate this drawback, in the prior art steps have been taken to extend the stroke of the piston of the accelerating pump. This solution improved the driveability of the engine when it is cold. However, when the engine is hot, during the initial stage of acceleration the mixture becomes excessively rich. Therefore, the engine experiences a disadvantageous condition called a hunting phenomenon.

SUMMARY OF THE INVENTION

Accordingly it is the general object of the present invention to provide a carburetor capable of providing a proper air fuel mixture to the engine during acceleration.

It is another object of the present invention to provide a carburetor capable of descreasing the NOx contained in the exhaust gases of an internal combustion engine during acceleration.

It is still another object of the present invention to provide a carburetor capable of preventing the increase of fuel consumption of a motor vehicle engine.

It is an additional object of the present invention to provide a carburetor capable of controlling acceleration only by means of an accelerometer.

It is a further object of the present invention to provide a carburetor which supplies the leaner normal air fuel mixture of an internal combustion engine when it is warm so as to improve fuel consumption.

It is yet a further object of the present invention to provide a carburetor which supplies the proper fuel air mixture for an internal combustion engine which has a simple construction.

In keeping with the principal of the present invention, the objects are accomplished by a unique carburetor having the accelerating pump for pushing fuel contained in the chamber of the pump into an air intake passageway of the carburetor by means of an accelerating pump piston during acceleration, a second pump chamber being expandable and contractable and communicating with the pump chamber via a throttle and a pressure control means for constantly applying pressure to said second pump chamber in a direction of contraction whereby said second pump chamber is allowed to expand only when fuel pressure in said second pump chamber exceeds a predetermined value.

BRIEF DESCRIPTION OF THE DRAWINGS

The above mentioned features and objects of the present invention will become more apparent with reference to the attached figures and the following description wherein like elements are given like referenced numerals and wherein.

DETAILED DESCRIPTION OF THE INVENTION

Figure 1:
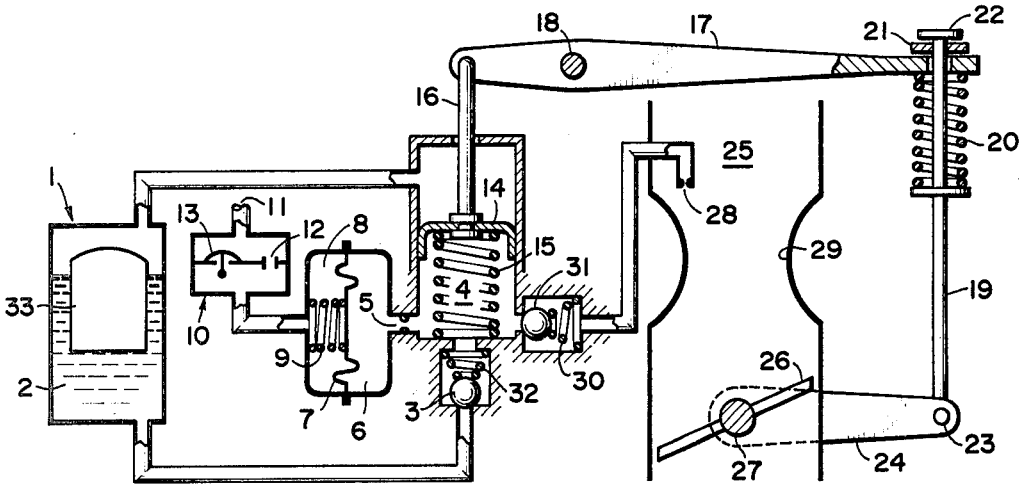
FIG. 1 is a sectional view illustrating a first embodiment of a carburetor in accordance with the teachings of the present invention.

Referring more particularly to the figures, shown in FIG. 1 is a sectional view illustrating a first embodiment of a carburetor in accordance with the teachings of the present invention. In FIG. 1 the carburetor includes a pump chamber 4 communicating with a float chamber 1 of the carburetor 1 through an inlet valve 3

Pump chamber 4 communicates with a second pump chamber 6 through a throttle 5. One side of the second pump chamber 6 is formed by a diaphragm 7. An atmospheric chamber 8 is formed in opposed relation to the second pump chamber 6 on the other side of diaphragm 7. Diaphragm 7 is biased in a direction of contracting or compressing the second pump chamber 6 by means of a spring 9 provided in the atmospheric chamber 8.

The atmospheric chamber 8 communicates through a negative pressure delaying valve 10 with the atmosphere. The negative pressure delaying valve 10 includes a throttle 12, a check valve 13 disposed in parallel with throttle 12 and an atmospheric port 11 open to the atmosphere. The check valve 13 is arranged and configured to allow air to flow from the atmospheric chamber 8 to the atmospheric port 11 and to impede air flow in the opposite direction.

An accelerating pump piston 14 is provided within the pump chamber 4 and is urged in a direction of expanding the pump chamber 4 by means of an accelerating spring 15 provided in the pump chamber 4. The pump piston 14 is connected to one end of a pump lever 17 by means of an accelerating piston rod 16 projecting upwardly from the pump piston 14.

The pump lever 17 is occillatingly supported by a shaft 18 and is connected to a pump rod 19. The pump rod 19 is connected to the pump lever 17 by means of a release spring 20 which abuts the lower portion of the pump lever 17 and a washer 21 and stopper 22 provided on the end of the pump rod 19 which are abutting engagement with the upper portion of the pump lever 17. By means of such coupling when the pump rod 19 is moved upward in the figures, excessive force is prevented from being applied to the pump lever 17 and accelerating piston 14.

The lower end of pump rod 19 is connected to the forward end of a throttle lever 24 via a pin 23 whereby when throttle valve 26 which is disposed in the air intake passageway 25 is opened the pump rod 19 is driven upwardly by means of the throttle shaft 27.

The carburetor further includes a float chamber 2 having a float 33 provided therein. The upper portion of the float chamber 2 communicates with the upper portion of the pump chamber 4. The lower portion of float chamber 2 communicates with the lower portion of the pump chamber 4 via a inlet valve 3 which consists of a ball biased in the direction of the float chamber by means of a spring 32. The pump chamber 4 further communicates with the air intake 25 by means of a ball valve 31 which communicates with a discharge nozzle 28 provided above the venturi flume 29 provided in the air intake passageway 25. The valve 31 consists of a ball biased in the direction of closing the pump chamber 4 by means of a discharge valve spring 30.

In operation, during rapid acceleration of the engine, the throttle valve 26 is rapidly open and this motion is transmitted to the accelerating pump piston 14 by means of the throttle shaft 27, throttle lever 24, pump rod 19, pump lever 17 and accelerating piston rod 19. The resultant downward movement of the accelerating pump piston 14 compresses the pump chamber 4. At this time, part of the fuel in the fuel pump chamber 4 pushes the discharge valve 31 open and is injected into the intake passageway 25 via the discharge nozzle 28. The remaining part of the fuel is pushed into the second pump chamber 6 via the throttle 5.

Since the atmospheric chamber 8 disposed in opposed relationship to the second pump chamber 6 on the other side of diaphragm 7 communicates with the atmosphere via the negative pressure delaying valve 10 and the check valve 13 provided in the negative pressure delaying valve 10 is open to allow air to flow from the atmospheric chamber 8 to the atmospheric port 11. Air in the atmospheric chamber 8 can be rapidly discharged to the atmosphere which allows the diaphragm 7 to be displaced commensurate with the flow rate of fuel flowing from the pump chamber 4 to the second pump chamber 6. In this way part of the accelerating fuel is temporarily stored in the second pump chamber 6 which has expanded or extended.

When the accelerating pump piston 14 reaches the end of its stroke, fuel in the pump chamber 4 ceases to be discharged to the discharge nozzle 28 through the discharge valve 21 by means of pressure caused by the accelerating pump piston 14. However, since the diaphragm 7 is urged in the direction of contracting the second pump chamber 6 by the resilient force of spring 9 and the atmospheric pressure is allowed to slowly enter the atmospheric chamber 8 via the throttle 12, fuel in the pump chamber 6 slowly returns to the pump chamber 4 and slowly is ejected through the discharge valve 31 into the intake passageway 25 by means of the discharge nozzle 28.

Consequently, part of the fuel from the pump chamber 4 is temporarily stored in the second pump chamber 6 during the initial stage of acceleration. In this manner the air fuel mixture during the initial stage of acceleration can be prevented from becoming excessively rich. Furthermore, fuel having been stored in the second pump chamber 6 is slowly ejected from the discharge nozzle 28 by the return of the diaphragm 7 after the completion of the operation of the accelerating piston 14 whereby the air fuel mixture is prevented from becoming too lean during the course of acceleration. In this manner the concentration of the air fuel mixture is properly maintained during acceleration and the driver's feel of acceleration is prevented from worsening and the amount of NOx in the exhaust gases is prevented from being increased. Additionally, there is no need to deeply depress the accelerating pedal during the last half stage of the acceleration process and therefore the fuel consumption of the engine is prevented from being increased.

Figure 2:
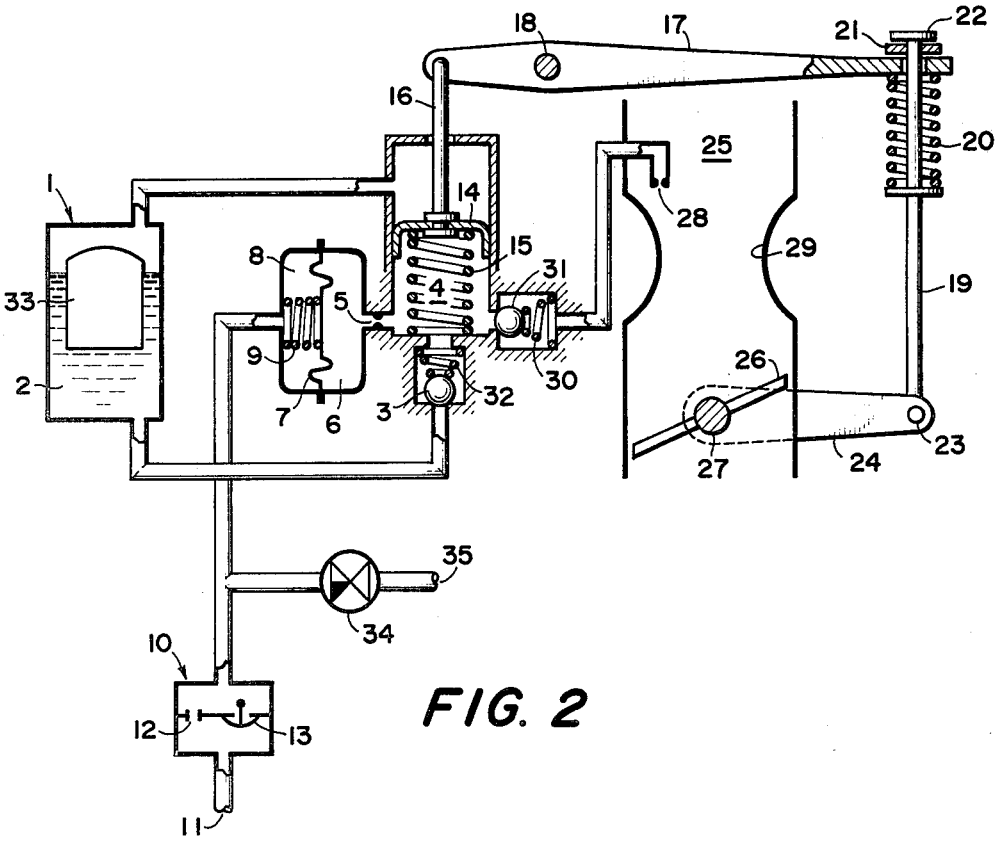
FIG. 2 is a sectional view illustrating a second embodiment of a carburetor in accordance with the teachings of the present invention.

Referring to FIG. 2, shown therein is a second embodiment of the carburetor in accordance with the teachings of the present invention. Since this embodiment is substantially the same as that of FIG. 1, like elements will be given like referenced numerals and a description of their interconnection in operation will be omitted.

In the second embodiment, a second atmospheric port 35 is connected to the atmospheric chamber 8. A temperature sensing valve 34 is provided between the second atmospheric port 35 and the atmospheric chamber 8. The temperature sensing valve is arranged and configured to sense the temperature of the engine (not shown) or the cooling water of the engine and connects the second atmospheric port 35 with the atmospheric chamber 8 when the temperature of the engine or engine water coolant is lower than a predetermined value and interrupts the connection between the second atmospheric port 35 and the atmospheric chamber 8 when the temperature of the engine or coolant water exceeds the predetermined value.

In operation, when the engine is cold or below the predetermined value, the temperature sensing valve 34 is open and the action of the negative pressure delaying valve 10 does not control the atmospheric chamber 8. Therefore fuel is temporarily stored in the second pump chamber 6 during acceleration for a shorter period of time and ejected into the intake passageway 25 through the discharge nozzle 28 in a shorter period of time.

Additionally, when the engine is hot or the temperature is above the predetermined value, the sensing valve 34 is closed and the operation of the atmospheric chamber 8 is controlled by the negative pressure delaying valve 10 in the same manner as described in FIG. 1.

In this second embodiment, there is an additional advantage in that when the engine is cold, the air fuel mixture is prevented from becoming lean by shortening the time for feeding the fuel into the engine during acceleration.

It should be apparent that the temperature sensing valve 34 may be a control valve adapted to communicate with the chamber 8 and the atmosphere depending on the temperature of the engine and therefore may be a solenoid valve 36 which is controlled by a temperature switch 39 which is supplied power from the battery 38 of the motor vehicle. The temperature switch 39 is of the type which turns on when the temperature of the engine exceeds a predetermined value and the solenoid valve 36 is of the type which closes the second atmospheric port 35 when the temperature switch 39 is turned on to energize the solenoid valve 36. It should be apparent that an opposite arrangement could be configured and provide the same result.

Figure 3:
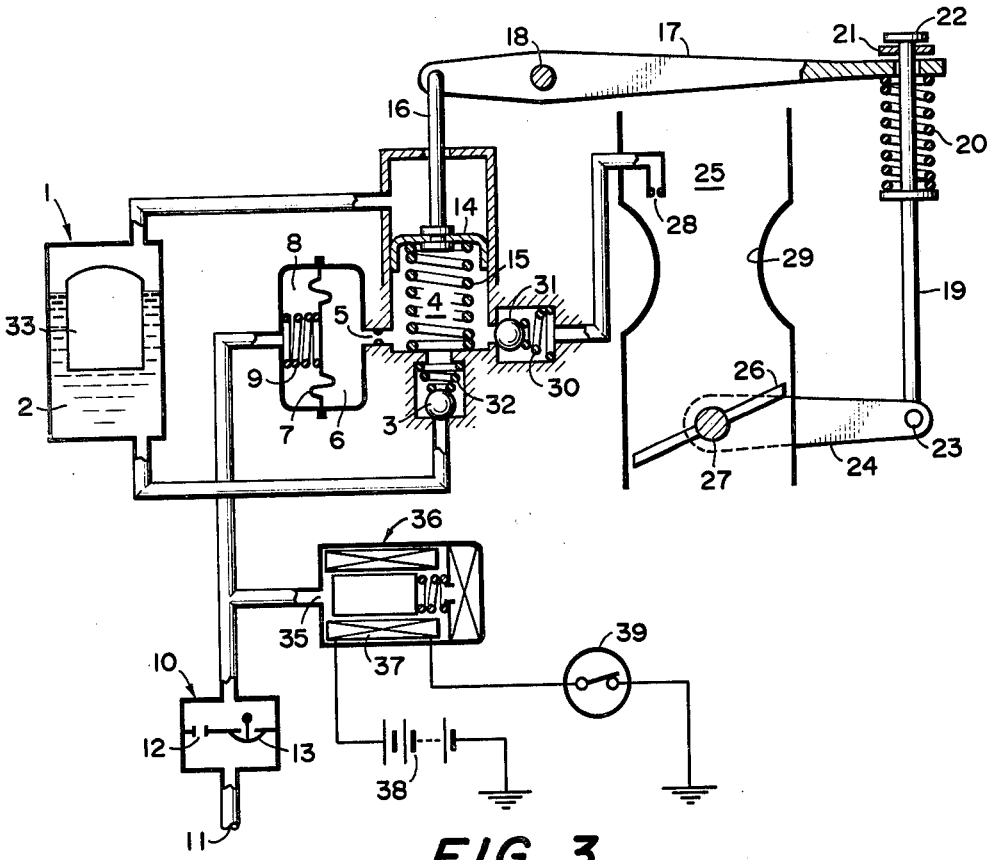
FIG. 3 is a third embodiment of a carburetor in accordance with the teachings of the present invention.
Figure 4:
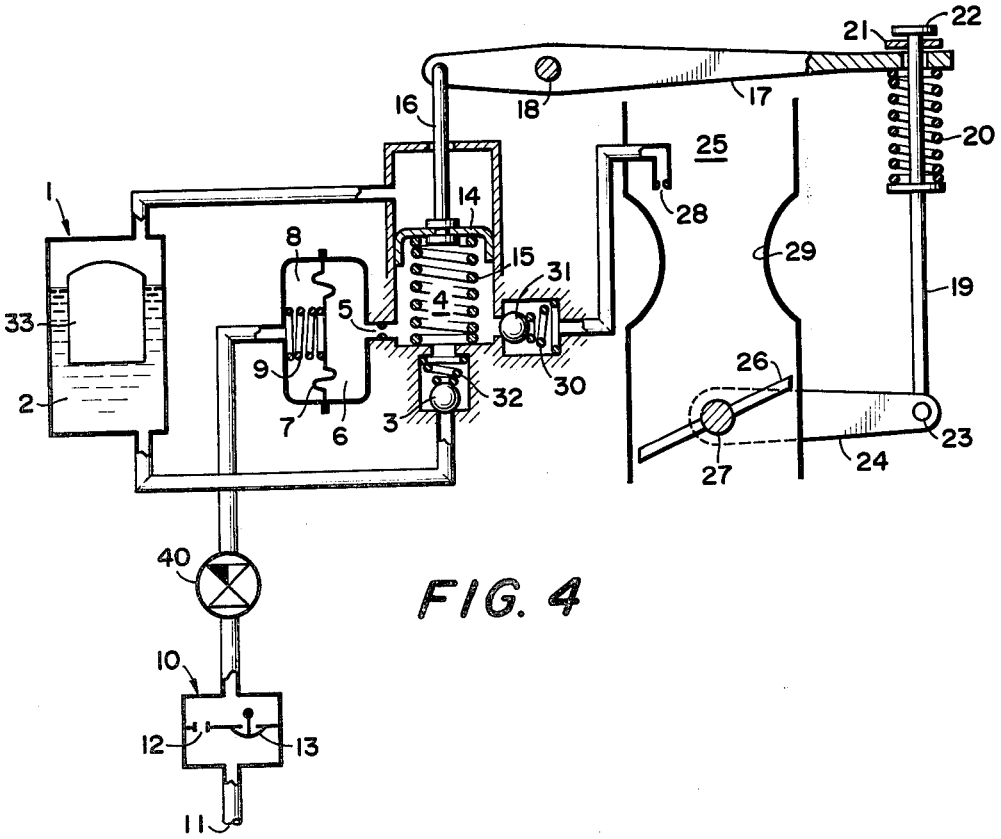
FIG. 4 is a schematic sectional view illustrating the essential portions of a fourth embodiment of a carburetor in accordance with the teachings of the present invention.

Referring to FIG. 4, shown therein is a fourth embodiment of a carburetor in accordance with the teachings of the present invention. Since the embodiment of FIG. 4 is substantially the same as that shown in FIGS. 3, 2 and 1, like elements are given like referenced numerals and a description of their interconnection and operation will be omitted.

In FIG. 4, a temperature sensing valve 40 is provided between the atmospheric chamber 8 and the negative pressure delaying valve 10. The temperature sensing valve 40 is of the type which closes the connection between the atmospheric chamber 8 and the negative pressure control valve 10 when the temperature of the engine is lower than a predetermined value.

In operation, when the engine is cold, the atmospheric chamber 8 does not communicate with the negative vacuum delaying valve 10 because the sensing valve 40 is closed. Hence, the second pump chamber 6 cannot practically expand and therefore fuel in the pump chamber 4 cannot be temporarily stored in the second pump chamber 6. Therefore all of the fuel from the pump chamber 4 is ejected from the discharge nozzle 28 in accordance with the movement of the accelerating pump 14. Consequently, in a cold state or when the temperature of the engine is below the predetermined value, all of the fuel for acceleration is fed directly into the engine. Additionally, when the temperature of the engine exceeds a predetermined value the negative pressure delaying valve 10 again communicates with the atmospheric chamber 8 and the operation of the atmospheric chamber 8 is controlled by the negative pressure delaying valve 10 in the same manner as described in relation to the embodiment shown in FIG. 1.

It should be apparent to one skilled in the art, that the above described embodiments are merely illustrative of but a few of the many possible specific embodiments which represent the applications of the principles of the present invention. Numerous and varied other arrangements could be readily devised by those skilled in the art without departing from the spirit and scope of the invention.

I claim:

1. A carburetor for an internal combustion engine, said carburetor having an accelerator pump for pushing fuel contained in a first pump chamber of said pump into an air intake of said carburetor when said accelerator pump is operated during acceleration, the improvement comprising:

a second pump chamber whose one wall is formed by a diaphragm, said second pump chamber communicating with said first pump chamber via a throttle; and a pressure control means for applying a controlled variable pressure to said pump chamber in a contracting direction, comprising:

an atmospheric chamber disposed in opposed relation to said second pump chamber and having said diaphragm as one wall thereof;

a spring provided in said atmospheric chamber biasing said diaphragm in a direction of contraction of said second pump chamber; and a negative pressure delaying valve means coupled to said atmospheric chamber and to the atmosphere, said negative pressure delaying valve means having a check valve and a throttle provided in parallel thereby allowing air from said atmospheric chamber to flow unimpededly through said check valve to the atmosphere and delaying air from flowing from the atmosphere through said throttle into said atmospheric chamber, wherein said atmospheric chamber further communicates with the atmosphere via a control valve, said control valve being arranged and configured to open when the temperature of said engine is lower than a predetermined value and is closed when the temperature of said engine is greater than a predetermined value.

2. A carburetor according to claim 1 wherein said control valve is a temperature sensing valve.

3. A carburetor according to claim 1 wherein said control valve comprises a solenoid valve which is normally closed when not excited and a temperature sensing switch for exciting said solenoid valve when the temperature of said engine is lower than said predetermined value.

4. A carburetor for an internal combustion engine, said carburetor having an accelerator pump for pushing fuel contained in a first pump chamber of said pump into an air intake of said carburetor when said accelerator pump is operated during acceleration, the improvement comprising:

a second pump chamber whose one wall is formed by a diaphragm, said second pump chamber communicating with said first pump chamber via a throttle; and a pressure control means for applying a controlled variable pressure to said second pump chamber in a contracting direction, comprising:

an atmospheric chamber disposed in opposed relation to said second pump chamber and having said diaphragm as one wall thereof;

a spring provided in said atmospheric chamber biasing said diaphragm in a direction of contraction of said second pump chamber;

a negative pressure delaying valve means coupled to said atmospheric chamber and to the atmosphere, said negative pressure delaying value means having a check valve and a throttle provided in parallel thereby allowing air from said atmospheric chamber to flow unimpededly through said check valve to the atmosphere and delaying air from flowing from the atmosphere through said throttle into said atmospheric chamber; and a temperature sensing valve provided between said atmospheric chamber and said negative pressure delaying valve means, said temperature sensing valve being arranged to configure to be closed when the temperature of the engine is lower than a predetermined value and is open when the temperature of the engine is greater than said predetermined value.

* * * * *